US005407893A

United States Patent [19]

Koshizuka et al.

[11] Patent Number: 5,407,893

[45] Date of Patent: Apr. 18, 1995

[54] MATERIAL FOR MAKING IDENTIFICATION CARDS

[75] Inventors: Kunihiro Koshizuka; Shigehiro Kitamura; Masataka Takimoto; Tomonori Kawamura, all of Hino, Japan

[73] Assignee: Konica Corporation, Tokyo, Japan

[21] Appl. No.: 109,367

[22] Filed: Aug. 19, 1993

[51] Int. Cl.[6] ..... B41M 5/035; B41M 5/38

[52] U.S. Cl. ..... 503/227; 427/152; 428/195; 428/216; 428/480; 428/483; 428/910; 428/913; 428/914

[58] Field of Search ..... 8/471; 428/195, 480, 428/483, 913, 914, 216, 910; 503/227; 427/152

[56] References Cited

U.S. PATENT DOCUMENTS 5,252,531 10/1993 Yasuda et al. ..... 503/227

*Primary Examiner*—B. Hamilton Hess

*Attorney, Agent, or Firm*—Frishauf, Holtz, Goodman & Woodward

[57] ABSTRACT

An ID card material comprises a thermal transfer image-receiving layer, and provided thereon, a substrate layer and a writing layer in this order, the substrate layer comprising a biaxially oriented polyester film layer having a thickness of 300 to 500 μm and a resin layer having a thickness of 30 to 500 μm selected from the group consisting of a polyolefin layer, a polyvinyl chloride type resin film layer and an ABS resin film layer.

13 Claims, 5 Drawing Sheets

MATERIAL FOR MAKING IDENTIFICATION CARDS

FIELD OF THE INVENTION

The present invention relates to a material for making identification cards, particularly to a material for making identification cards high in stiffness and excellent in durability.

BACKGROUND OF THE INVENTION

Recently, there have come widely used various types of identification cards such as licenses including driving licenses, membership cards with a photograph of the holder's face, certification cards and business cards with a photograph of the holder's face.

For example, driving licenses, the most popular identification cards, are made by the steps of forming a photograph of the holder's face on a support through silver salt photography, recording necessary information thereon through printing, and further providing a protective layer thereon. Forming a photograph of the holder's face by silver salt photography, however, needs a complicated multi-stage procedure comprising exposing, developing, fixing, bleaching, etc.; therefore, it is not always applicable to a job site where a large amount of such identification cards must be prepared in a short time.

Under the conditions as stated above, studies have been carried on with the aim of producing identification cards of fine images rapidly and in large quantities and, as the result, the present inventors have developed a process for the production of identification cards which comprises the main processes of forming, on an image receiving layer provided on the surface of a substrate layer, gradation information containing images by sublimation thermal image transfer recording as well as character information containing images describing necessary information by, for example, heat-fusible thermal transfer recording and, after providing a protective layer on the above gradation information containing images, forming a cured protective layer on the whole surface of the image receiving layer by coating an ultraviolet-curable resin and irradiating ultraviolet rays on it.

In the studies to develop this process, it has also been found that the material for identification cards with adequate mechanical strengths must have a certain level of stiffness, and that a single-layered resin sheet is unfit as a material for making such identification cards.

SUMMARY OF THE INVENTION

Accordingly, an object of this invention is to provide a material for making identification cards (hereinafter referred to as an ID card material) having adequate mechanical strengths and excellent durabilities.

As means to achieve the foregoing object, the invention involves an ID card material obtained by laminating an image receiving layer which forms images by receiving a heat-diffusible dye, a substrate layer and a writing layer in this order, wherein the substrate layer is a composite layer selected from a group consisting of 1. a composite layer on the image receiving layer side, a biaxially oriented polyester film layer and provided at least one layer selected from a group consisting of a polyolefin layer, a polyvinyl chloride type resin film layer and an ABS resin film layer, and a biaxially oriented polyester film layer in this order,
2. a composite layer and provided on the image receiving layer side at least one layer selected from a group consisting of a polyolefin layer, a polyvinyl chloride type resin film layer and an ABS resin film layer, and a biaxially oriented polyester film layer in this order, and
3. a composite layer and provided on the image receiving layer side at least one layer selected from a group consisting of a polyolefin layer, a polyvinyl chloride type resin film layer and an ABS resin film layer, and at least one layer selected from a group consisting of a biaxially oriented polyester film layer, a polyolefin layer, a polyvinyl chloride type resin film layer and an ABS resin film layer in this order, or a layer consisting of a biaxially oriented polyester film layer.

The invention involves an ID card material defined in the above, wherein the composite layer is one formed by laminating a polyethylene layer or a polypropylene layer on each side of a biaxially oriented polyester film layer.

The invention involves an ID card material, wherein the composite layer is one formed by laminating a polyethylene layer or a polypropylene layer on each side of a biaxially oriented polyester film layer via an adhesive layer.

The invention involves an ID card material, wherein the composite layer is that in which a white opacifying layer is provided at least at one interlayer position between the image receiving layer and the substrate layer, between the layers which constitute the substrate layer, and between the substrate layer and the writing layer.

The invention involves an ID card material, wherein the polyethylene layer or the polypropylene layer contains a white pigment.

The invention involves an ID card material, wherein the biaxially oriented polyester film layer in the composite layer has a thickness of 300 to 500 μm.

The invention involves an ID card material, wherein the biaxially oriented polyester film layer, which constitutes the substrate layer, is formed of polyethylene terephthalate containing a white pigment and has a thickness of 300 to 500 μm.

The invention involves an ID card material, wherein an adhesive layer is provided between the image receiving layer and the substrate layer.

The invention involves an ID card material, wherein a white opacifying layer is provided between the image receiving layer and the substrate layer or between the writing layer and the substrate layer.

DETAILED DESCRIPTION OF THE INVENTION

The invention is hereunder described in detail.

The ID card material according to the invention comprises an image receiving layer to form images by receiving a heat-diffusible dye, a substrate layer and a writing layer respectively laminated in this order.

Substrate Layer

Figure 1:
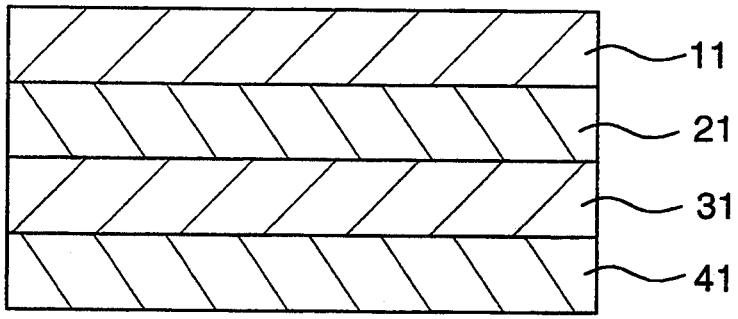
FIG. 1 is a cross-sectional view of one preferable layer configuration of the ID card material according to the invention.
Figure 2:
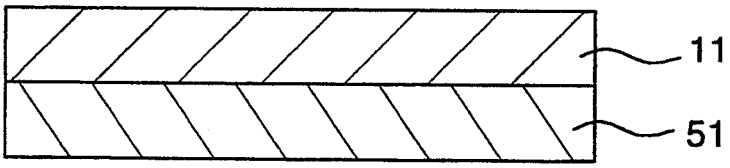
FIG. 2 is a cross-sectional view of another preferable layer configuration of the ID card material according to the invention.
Figure 3:
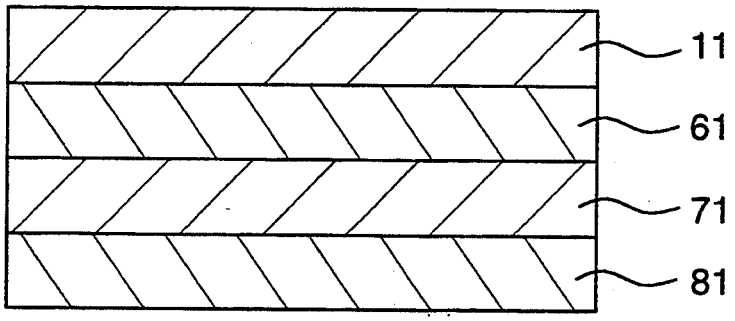
FIG. 3 is a cross-sectional view of another preferable layer configuration of the ID card material according to the invention.
Figure 4:
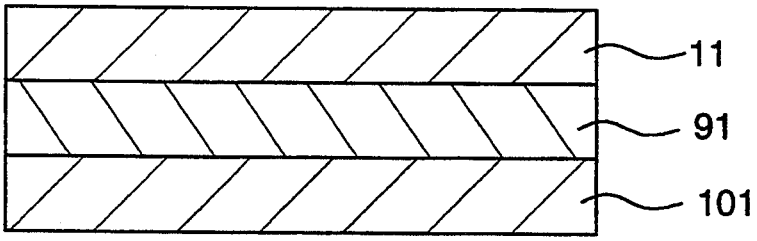
FIG. 4 is a cross-sectional view of another preferable layer configuration of the ID card material according to the invention.
Figure 5:
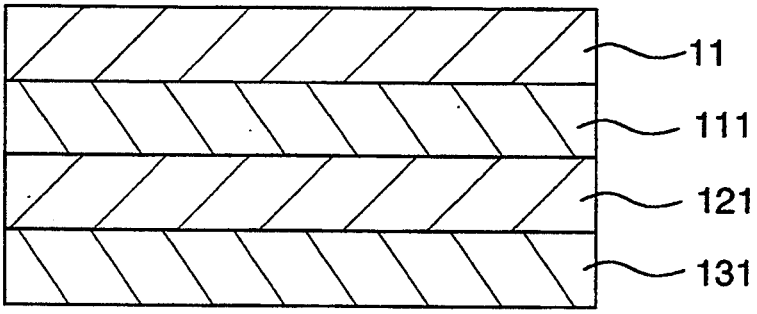
FIG. 5 is a cross-sectional view of still another preferable layer configuration of the ID card material according to the invention.

In the embodiment of the invention, preferred modes of the substrate layer include 1. a composite layer of FIG. 1 comprising biaxially oriented polyester film layer 31 and polyethylene layers or polypropylene layers 21 and 41 which are provided on both sides of the polyester film layer,
2. a single layer of FIG. 2 comprising biaxially oriented polyester film layer 51 alone,
3. a composite layer of FIG. 3 comprising biaxially oriented polyester film layer 61 located on the image receiving layer 11 side, at least one layer 71 selected from a group consisting of a polyolefin layer, a polyvinyl chloride type resin film layer and an ABS resin film layer and, biaxially oriented polyester film layer 81, which are provided in this order,
4. a composite layer located on the image receiving layer 11 side of FIG. 4 comprising at least one layer 91 selected from a group consisting of a polyolefin layer, a polyvinyl chloride type resin film layer and an ABS resin film layer, and biaxially oriented polyester film layer 101, which are provided in this order,
5. a composite layer located on the image receiving layer 11 side of FIG. 5 comprising at least one layer 111 selected from a group consisting of a polyolefin layer, a polyvinyl chloride type resin film layer and an ABS resin film layer, biaxially oriented polyester film layer 121 and at least one layer 131 selected from a group consisting of a polyolefin layer, a polyvinyl chloride type resin film layer and an ABS resin film layer, which are provided in this order,
6. a composite layer shown in FIG. 1 as the substrate layer, in which adhesive layers are provided between biaxially oriented polyester film layer 31 and polyethylene layers or polypropylene layers 21 and 41,
7. a composite layer shown in FIG. 2 as the substrate layer, in which an adhesive layer is provided between image receiving layer 11 and the substrate layer,
8. a composite layer shown in FIG. 1 or 2 as the substrate layer, in which a white opacifying layer is provided at least at one interlayer position between the layers which constitute the substrate layer and between the image receiving layer 11 and the substrate layer,
9. a composite layer shown in FIG. 1 as the substrate layer, in which polyethylene layers or polypropylene layers 21 and 41 are ones containing a white pigment,
10. a composite layer shown in FIG. 2 as the substrate layer, in which the biaxially oriented polyester film layer contains a white pigment,
11. a composite layer shown in FIG. 4 as the substrate layer of double-layer structure, in which at least one layer 91 located on the image receiving layer 11 side and selected from a group consisting of a polyolefin layer, a polyvinyl chloride type resin film layer and an ABS resin film layer is a white opacifying layer, and
12. a composite layer shown in FIG. 5 as the substrate layer of triple-layer structure, in which at least one layer 111 located on the image receiving layer 11 side and selected from a group consisting of a polyvinyl chloride type resin film layer and an ABS resin film layer is a white opacifying layer.

In the foregoing modes, the polyester used in the biaxially oriented polyester film layer may be one manufactured by conventional methods, a typical example thereof is polyethylene terephthalate.

The polyolefin used in the polyolefin layer of the foregoing modes includes polyethylene, polypropylene, polybutene, polystyrene, ethylene-propylene copolymers and ethylene-vinyl acetate copolymers. Further, there may also be used chlorinated polyolefins including chlorinated polyethylene and modified polyolefins including chemically modified polyethylene and chemically modified polypropylene.

The foregoing polypropylene may be either a homopolymer of propylene or a copolymer containing another comonomer such as ethylene.

Preferred polyolefins used in the polyolefin layer are polyethylene, mixtures of polyethylene and polypropylene (particularly preferred are polyethylene-rich mixtures) and polypropylene. When polyethylene or polyethylene-rich polyethylene-polypropylene mixtures are used in the polyolefin layer, this polyolefin layer is specifically referred to as a polyethylene layer; when polypropylene-rich polyethylene-polypropylene mixtures or polypropylenes are used, this polyolefin layer is specifically referred to as a polypropylene layer.

Polyethylene used in the polyethylene layer of the foregoing modes include ethylene homopolymers, ethylene-propylene copolymers, ethylene-vinyl acetate copolymers, chlorinated polyethylenes and modified polyethylenes such as chemically modified polyethylenes.

Polypropylenes used in the polypropylene layer of the foregoing modes include propylene homopolymers, propylene-ethylene copolymers, propylene-vinyl acetate copolymers, chlorinated polypropylenes and modified polypropylenes such as chemically modified polypropylenes.

The vinyl chloride type resin film layer of the foregoing modes includes layers mainly comprising a vinyl chloride type resin. Such a vinyl chloride type resin film layer contains 50 wt % or more vinyl chloride type resins and other thermoplastic resins.

Preferred vinyl chloride type resins include polyvinyl chloride resins and vinyl chloride copolymers. Suitable examples of the vinyl chloride copolymers are copolymers of vinyl chloride and other comonomers which contain 50 mol % or more vinyl chloride monomer unit.

The other comonomers stated above are, for example, vinyl esters of fatty acid such as vinyl acetate, vinyl propionate, tallow acid vinyl ester; acrylic acid, methacrylic acid and their alkyl esters such as methyl acrylate, methyl methacrylate, ethyl methacrylate, butyl acrylate, 2-hydroxyethyl methacrylate, 2-ethylhexyl acrylate; maleic acid and its alkyl esters such as diethyl maleate, dibutyl maleate, dioctyl maleate; and alkyl vinyl ethers such as methyl vinyl ether, 2-ethylhexyl vinyl ether, lauryl vinyl ether, palmityl vinyl ether, stearyl vinyl ether.

The foregoing comonomers include ethylene, propylene, acrylonitrile, methacrylonitrile, styrene, chlorostyrene, itaconic acid and its alkyl esters, crotonic acid and its alkyl esters, halogenated olefins such as dichloroethylene and trifluoroethylene, cycloolefins such as cyclopentene, aconitates, vinyl benzoate, benzoyl vinyl ether.

The vinyl chloride copolymers may be any of block copolymers, graft copolymers, alternating copolymers and random copolymers. Further, if occasion demands, these copolymers may be ones containing monomer units having releasing properties such as silicone compounds.

In forming the ABS resin film layer in the foregoing modes, there can be used conventional ABS resins available on the market.

In a preferable embodiment of the invention, an adhesive layer is provided at one of interlayer positions between the image receiving layer and the substrate layer, between the layers constituting the substrate layer when the substrate layer is in the composite structure, and between the substrate layer and the writing layer.

This adhesive layer can be formed by use of conventional adhesives of aqueous solution type, emulsion type, solvent type, solventless type, solid type, or those in the form of films, tapes, webs.

Examples of such adhesives include natural high polymer types such as starches; semisynthetic natural high polymer types such as cellulose acetates; thermoplastic resin types such as polyvinyl acetate adhesives, polyvinyl chloride adhesives; thermosetting resin types such as epoxy adhesives, urethane adhesives; rubber types such as chloroprene adhesives and NBR adhesives; inorganic high polymer types such as silicates, alumina cements, low melting glasses; and ultraviolet curing types such as acrylics, epoxides.

When the substrate surface on the image receiving layer side is formed of a plastic such as polyolefin, polyester or polyvinyl chloride, it is desirable to use a reactive adhesive which cures or polymerizes by chemical reaction.

Examples of such reactive adhesives include thermosetting types such as epoxides, resols; moisture-curing types such as 2-cyanoacrylates, silicones, alkyl titanates; anaerobic curing types such as acrylic oligomers; ultraviolet curing types; radical polymerization types; condensation types such as urea adhesives; and addition polymerization types such as epoxides, isocyanates.

In the embodiment of the invention, it is preferred that a white opacifying layer be provided at an interlayer position between the layers to constitute the substrate layer, between the substrate layer and the image receiving layer, or between the substrate layer and the writing layer. This white opacifying layer can be watermarked by printing to prevent forgery of or tampering with ID card materials.

A preferred white opacifying layer can be formed by incorporating a white pigment in the foregoing polyolefin, vinyl chloride type resin or ABS resin. Suitable white pigments are, for example, titanium white, magnesium carbonate, zinc oxide, barium sulfate, silica, talc, clay and calcium carbonate.

These white pigments may also be contained in one of the layers which constitute the substrate layer of the foregoing modes. For example, these can be incorporated in the polyethylene layer or polypropylene layer. Further, these can be incorporated in the biaxially oriented polyester film layer to constitute the composite layer or in the biaxially oriented polyester single layer which is the substrate layer by itself. Incorporating a white pigment substantially enhances the sharpness of images formed in later processes.

The content of these white pigments in respective layers is usually 0.5 to 50.0 wt %, preferably 5.0 to 40.0 wt %.

In any of the foregoing modes, each layer which constitutes the substrate layer may contain various additives for the improvement of various necessary properties according to specific requirements.

In any of the foregoing modes, the substrate layer can be formed by means of conventional methods such as coating, lamination, co-extrusion and hot-melt extrusion. When the substrate layer is formed by means of lamination, it is preferred to provide an adhesive layer between the layers constituting the substrate layer.

The thickness of the image receiving layer in the ID card material is usually 1.0 to 50.0 μm, preferably 2.0 to 30.0 μm.

The thickness of the biaxially oriented polyester film layer is usually 300 to 500 μm, preferably 350 to 480 μm. The thickness of the other layer is usually 30 to 350 μm, preferably 50 to 250 μm. The thickness of the writing layer is 2 to 100 μm, and preferably, 5 to 80 μm. The thickness of the polyolefin layer is 10 to 200 μm, and preferably, 15 to 100 μm. The thickness of the polyvinyl chloride type resin film layer is 20 to 350 μm, and preferably, 30 to 200 μm. The thickness of the ABS resin film layer is 20 to 350 μm, and preferably, 30 to 200 μm. The thickness of the white covering layer is 1 to 30 μm, and preferably, 2 to 20 μm. And the overall thickness of the ID card material is 200 to 1,000 μm, preferably 250 to 850 μm. By keeping the thickness of each constituent layer and the overall thickness of the ID card material within the above ranges respectively, an adequate stiffness can be given to the ID card material. When an adhesive layer is provided, its thickness is usually 0.01 to 50 μm, preferably 0.02 to 30 μm.

Image Receiving Layer

The ID card material of the invention has on its surface an image receiving layer to form images by receiving a heat-diffusible dye, and the image receiving layer is supported by the substrate layer which can take any of the foregoing modes.

The image receiving layer is a layer on which images with gradation are formed by the diffusion of a heat-diffusible dye according to the sublimation thermal transfer recording method which uses an ink sheet for sublimation thermal transfer recording. Accordingly, the image receiving layer may be formed of any material, as long as it can receive a heat-diffusible dye which diffuses on heating from the ink layer provided in an ink sheet for sublimation thermal transfer recording.

In forming the image receiving layer according to the invention, there can be used various binder resins such as vinyl chloride type resins, polyester resins, polycarbonate resins, acrylic resins and other heat-resistant resins.

When specific requirements arise with respect to the images to be formed (for example, a specific heat stability required of identification cards to be issued), the type of resin or combination of resins must be appropriately selected so as to fill such requirements.

When the heat stability of images is taken as an example, in case that a heat stability of 60° C. or more is required, it is preferred to employ a resin of which Tg is 60° C. or more in order to prevent a heat-diffusible dye from bleeding through.

Types of resins to form the image receiving layer may be arbitrarily selected. But, in view of image preservability, it is preferred to use vinyl chloride type resins such as polyvinyl chloride resins and vinyl chloride coplymers. Suitable vinyl chloride coplymers include copolymers of vinyl chloride and other comonomers containing 50 mol % or more vinyl chloride monomer unit.

Examples of such other comonomers include fatty acid vinyl esters such as vinyl acetate, vinyl propionate, tallow acid vinyl ester; acrylic acid, methacrylic acid and their alkyl esters such as methyl acrylate, ethyl methacrylate, butyl acrylate, 2-hydroxyethyl methacrylate, 2-ethylhexyl acrylate; maleic acid and its alkyl esters such as diethyl maleate, dibutyl maleate, dioctyl maleate; and alkyl vinyl ethers such as methyl vinyl ether, 2-ethylhexyl vinyl ether, lauryl vinyl ether, palmityl vinyl ether, stearyl vinyl ether.

Examples of the foregoing comonomers include ethylene, propylene, acrylonitrile, methacrylonitrile, styrene, chlorostyrene, itaconic acid and its alkyl esters, crotonic acid and its alkyl esters, halogenated olefins such as dichloroethylene and trifluoroethylene, cycloolefins such as cyclopentene, aconitates, vinyl benzoate, benzoyl vinyl ether.

The vinyl chloride copolymer may be any of block copolymers, graft copolymers, alternating copolymers and random copolymers. Further, if there are specific requirements, these copolymers may be ones comprising monomer units having releasing properties such as silicone compounds.

Besides the above vinyl chloride type resins, polyester resins can also be used favorably as a resin to form the image receiving layer. Examples thereof include those compounds which are disclosed in Japanese Pat. O.P.I. Pub. Nos. 188695/1983 and 244696/1987. Further, polycarbonate resins can also be used likewise; preferred examples include the compounds disclosed in Japanese Pat. O.P.I. Pub. No. 169694/1987.

As the foregoing heat resistant resins, various conventional heat resistant resins can be used on condition that these have a good heat resistance, a moderate softening point or glass transition point (not excessively low), a moderate compatibility with the vinyl chloride type resins, and substantially no color.

By the term "heat resistance" used here, it is meant that the resins undergo neither coloring like yellowing nor deterioration in physical strength when kept at a high temperature. Preferred heat resistant resins are those of which softening point is 50° to 200° C. and of which glass transition point is 80° to 150° C. A resin whose softening point is lower than 50° C. has a disadvantage of causing the ink sheet and the image receiving layer to fuse in the process of transferring a heat-diffusible dye. And a resin whose softening point is higher than 200° C. has a disadvantage of lowering the sensitivity of the image receiving layer.

Heat resistance resins which meet the above requirements are phenolic resins, melamine resins, urea-aldehyde resins and ketone resins; among them, urea-aldehyde resins and ketone resins are preferred.

Urea-aldehyde resins are obtained by condensation reaction between urea and aldehydes (mostly formaldehyde), and ketone resins are obtained by condensation reaction between a ketone and formaldehyde. While many types of ketone resins are known according to ketones used as a raw material, any ketone resin can be used in the invention. Ketones suitable as a raw material are, for example, methyl ethyl ketone, methyl isobutyl ketone, acetophenone, cyclohexanone and methylcyclohexanone.

As such urea-aldehyde resins, Laropal A-81, Laropal A-101 (made by BASF A.G.), etc. are available on the market and, as such ketone resins, Laropal K-80 (made by BASF A.G.), etc. are on the market.

The thickness of the image receiving layer is usually 1.0 to 50.0 μm, preferably 2.0 to 30.0 μm.

Preferably, the image receiving layer is laminated on the surface of various types of substrate layers described above via an adhesive layer of a polyester or polyurethane resin.

Writing Layer

The writing layer is provided to make the reverse side of identification cards writable. Such a writing layer can be formed, for example, in the same manner as the writing layer disclosed in Japanese Pat. O.P.I. Pub. No. 205155/1989.

Preparation of Identification Cards

The ID card material of the invention is made up into identification cards by the following procedure:

The image receiving layer of an ID card material is brought into contact with the ink layer of an ink sheet for sublimation thermal transfer recording, and then gradation information containing images are formed by heating the ink sheet imagewise with a heating means such as a thermal head to allow a heat-diffusible dye to diffuse to the image receiving layer. Next, various characters are thermally transferred onto the surface of the image receiving layer where no gradation information containing images are formed by the sublimation thermal transfer recording method using an ink sheet for sublimation thermal transfer recording, or by the heat-fusible thermal transfer recording method using an ink sheet for heat-fusible thermal transfer recording. Then, a transparent protective layer is formed on the surface of the image receiving layer where gradation information containing images are formed by the coating method, by the hot-stamping method using a transparent sheet, or by other methods. Subsequently, an ultraviolet-curing resin is coated on the whole image receiving layer, followed by ultraviolet-light irradiation to form an ultraviolet-cured layer.

The ink sheet for sublimation thermal transfer recording used here is not particularly limited, and conventional ones can be employed.

The identification card so obtained is stiff, durable and free from the delamination of the image receiving layer from the ID card material.

EXAMPLES

The invention is illustrated by the following Examples, in which "parts" are "parts by weight" unless otherwise indicated.

Example 1

A urethane type curing adhesive layer was coated at a coating weight of 1.0 g/m$^2$ on a 350-μm thick, white biaxially oriented polyethylene terephthalate film (made by I.C.I.), then a propylene-ethylene copolymer layer was extrusion-coated thereon to a thickness of 50-μm. Further, the urethane type curing adhesive was coated at a coating weight of 1.0 g/m$^2$ on the other side of the film, followed by extrusion-coating thereon a 50-μm thick propylene-ethylene copolymer layer. After providing a corona discharge treatment on one side of the substrate so prepared, a writing layer of the following composition 2 was formed thereon, and a 5-μm thick image receiving layer was formed on the other side by coating a polyvinyl chloride type resin solution of the following composition 1 to prepare an ID card.

Figure 6:
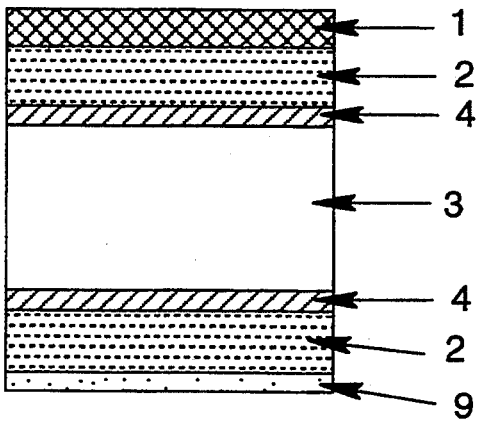
FIG. 6 is a cross-sectional view of one identification card formed by use of an ID card material prepared in one embodiment of the invention.

As shown in FIG. 6, the layer configuration of this ID card material was polyvinyl chloride type resin layer (image receiving layer) 1/polyolefin layer 2/adhesive layer 4/white, biaxially oriented polyethylene terephthalate film layer 3/adhesive layer 4/polyolefin layer 2/writing layer 9.

| | |
|---|---|
| Composition 1 | |
| Polyvinyl chloride type resin (Esmedica made by Sekisui Chem. Co.) | 9.5 parts |
| Modified silicone resin (X24-8300 made by Shin-Etsu Chem. Co.) | 0.5 part |
| Methyl ethyl ketone | 60.0 parts |
| Cyclohexanone | 30.0 parts |
| Composition 2 | |
| Colloidal silica | 2.5 parts |
| 10% gelatin solution | 75.0 parts |
| Surfactant | 0.2 part |

After cutting the ID card material into the card size conforming to the JIS standard, character images were recorded on the cut ID card material using a heat-fusible thermal transfer printer, and non-character images were then recorded using a sublimation type thermal transfer printer. Subsequently, the whole image area was coated with a polymer protective layer by hot-stamping, and an ultraviolet-curable resin was coated thereon to a thickness of 10 μm and cured with a high pressure mercury ultraviolet lamp. The shape and stiffness of the card samples so obtained were evaluated using the following criteria. The results are shown in Table 1.

Shape:

Visual checking was conducted for curling and thermal deformation.

Stiffness:

A card sample was nipped in longitudinal direction at its both ends with the thumb and the first finger, and the sample was visually checked for liability to curling by applying pressure to the center of the sample at its both ends.

A: curling is difficult to occur.

B: curling occurs slightly.

C: curling occurs readily.

Curling under Prolonged Forced Deforming:

A card sample was wound on a 80-mm diameter roll and allowed to stand at 40° C. for 24 hours. Then, the sample was detached from the roll at room temperature and visually checked for curling. In Table 1 which shows the results, the letters A, B and C have the same meanings as those defined for the stiffness.

Example 2

A urethane type curing adhesive layer was coated at a coating weight of 1.0 g/m$^2$ on one side of a 50-μm thick biaxially oriented polyethylene terephthalate film having a haze of 87% (made by Diafoil Co.), and a 50-μm thick polypropylene layer was extrusion-coated thereon. Further, the urethane type curing adhesive layer was coated at a coating weight of 1.0 g/m$^2$ on the other side of the film, followed by extrusion-coating of a 50-μm thick polypropylene layer on this adhesive layer. After providing a corona discharge treatment on one side of the substrate so prepared, an anchoring layer of the following composition 3 was formed at a coating weight of 0.5 g/m$^2$ and, further, the above polyvinyl chloride type resin solution of composition 1 was coated thereon so as to form a 5-μm thick image receiving layer. The ID card material obtained was made up into cards and evaluated by the same procedure as Example 1. The results are shown in Table 1.

Figure 7:
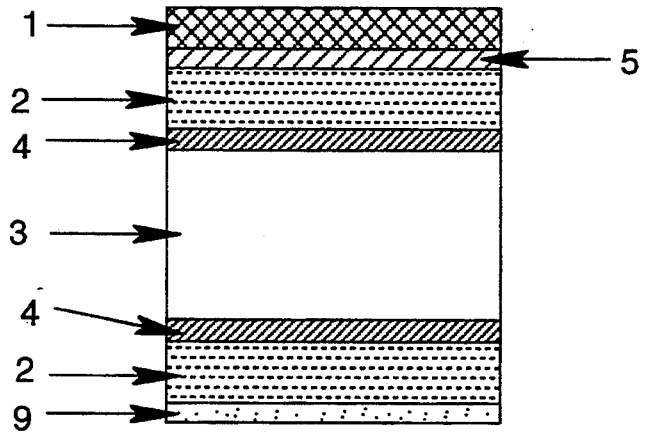
FIG. 7 is a cross-sectional view of another identification card formed by use of an ID card material prepared in one embodiment of the invention.

As shown in FIG. 7, the layer configuration of this ID card material was polyvinyl chloride type resin layer (image receiving layer) 1/anchoring layer 5/polypropylene layer adhesive layer 4/biaxially oriented polyethylene terephthalate film layer 3/adhesive layer 4/polypropylene layer 2/writing layer 9.

| | |
|---|---|
| Composition 3 | |
| Polyester resin (PESUREJIN S-110) | 9.0 parts |
| Isocyanate (Coronate HX made by Nippon Polyurethane Ind.) | 1.0 part |
| Toluene | 45.0 parts |
| Methyl ethyl ketone | 45.0 parts |

Example 3

A urethane type curing adhesive layer was coated at a coating weight of 1.0 g/m$^2$ on one side of a 350-μm thick biaxially oriented polyethylene terephthalate film having a haze of 76% (made by Diafoil Co.), and a 50-μm thick white polypropylene layer (containing 15 wt % titanium oxide) was extrusion-coated thereon. Further, the urethane type curing adhesive layer was coated at a coating weight of 1.0 g/m$^2$ on the other side of the film, and then a 70-μm thick YUPO synthetic paper bearing a writing layer of composition 2 of Example 1 was extrusion-laminated thereon by extruding a molten, white polypropylene in a thickness of 20 μm thick layer. After providing a corona discharge treatment on the white polypropylene layer of the substrate obtained, the anchoring layer of the foregoing composition 3 was formed at a coating weight of 0.5 g/m$^2$ and, further, the above polyvinyl chloride type resin solution of composition 1 of Example 1 was coated thereon to form a 5-μm thick image receiving layer. The ID card material prepared was made up into cards and evaluated in the same manner as in Example 1; the results are shown in Table 1.

Figure 8:
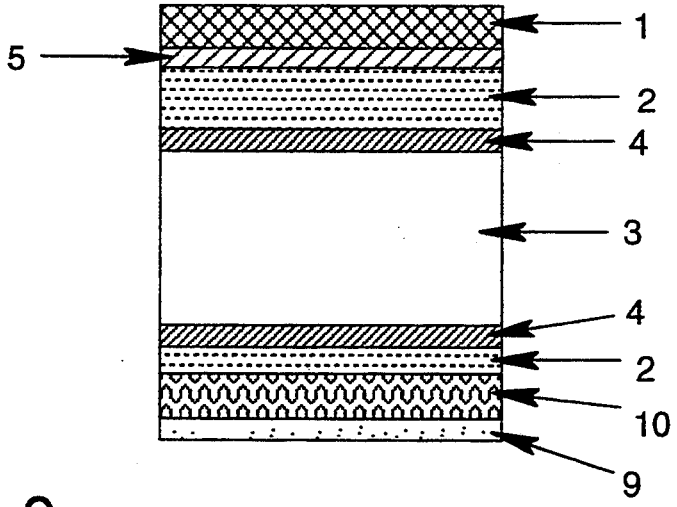
FIG. 8 is a cross-sectional view of another identification card formed by use of an ID card material prepared in one embodiment of the invention.

As shown in FIG. 8, the layer configuration of this ID card material was polyvinyl chloride type resin layer (image receiving layer) 1/anchoring layer 5/white polypropylene layer 2/adhesive layer 4/biaxially oriented polyethylene terephthalate film layer 3/adhesive layer 4/white polypropylene layer 2/YUPO synthetic paper 10/writing layer 9.

Example 4

An ID card material was prepared by repeating the procedure of Example 3, except that a white opacifying layer of the following composition 4 was formed at a coating weight of 10 g/m$^2$ on the image receiving layer side of the biaxially oriented polyethylene terephthalate film layer in Example 3. This ID card material was made up into cards and evaluated in the same manner as in Example 1; the results are shown in Table 1.

Figure 9:
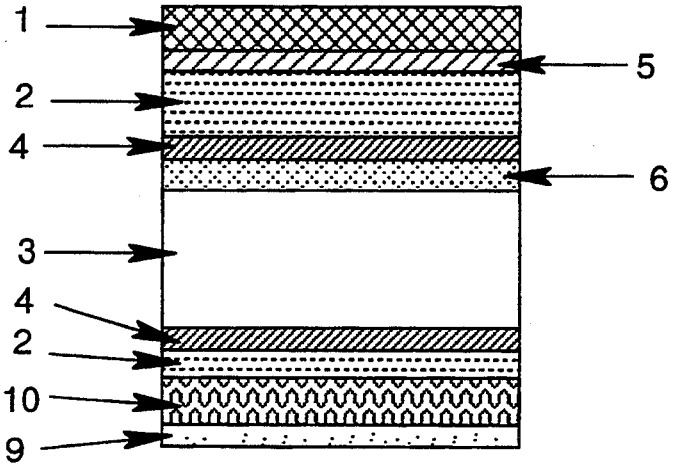
FIG. 9 is a cross-sectional view of another identification card formed by use of an ID card material prepared in one embodiment of the invention.

As seen in FIG. 9, the layer configuration of this ID card material was polyvinyl chloride type resin layer (image receiving layer) 1/anchoring layer 5/white polypropylene layer 2/adhesive layer 4/white opacifying layer 6/biaxially oriented polyethylene terephthalate film layer 3/adhesive layer 4/white polypropylene layer 2/YUPO synthetic paper 10/writing layer 9.

| Composition 4 | |
|---|---|
| Acrylic resin (BR-113 made by Mitsubishi Rayon Co.) | 8.8 parts |
| Titanium oxide dispersion (solid content: 60%) (MHI white No. 148 made by Mikuni Shikiso Co.) | 44.4 parts |
| Isocyanate (Coronate HX made by Nippon Polyurethane Ind.) | 1.1 parts |
| Methyl ethyl ketone | 45.7 parts |

Example 5

An ID card material was prepared in the same manner as in Example 3, except that a white opacifying layer of composition shown in Example 3 was formed at a coating weight of 10 g/m$^2$ on the writing layer side of the biaxially oriented polyethylene terephthalate film. This ID card material was made up into cards and evaluated as in Example 1, the results are shown in Table 1.

Figure 10:
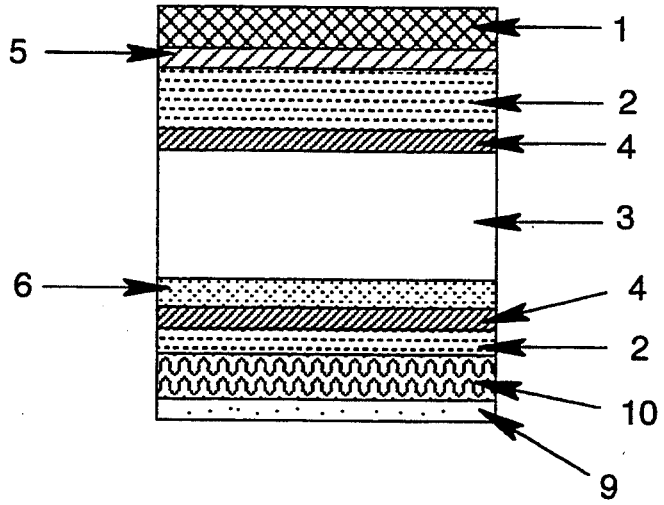
FIG. 10 is a cross-sectional view of another identification card formed by use of an ID card material prepared in one embodiment of the invention.

As shown in FIG. 10, the layer configuration of this ID card material was polyvinyl chloride type resin layer (image receiving layer) 1/anchoring layer 5/white polypropylene layer adhesive layer 4/biaxially oriented polyethylene terephthalate film layer 3/white opacifying layer 6/adhesive layer 4/white polypropylene layer 2/YUPO synthetic paper 10/writing layer 9.

Example 6

An ID card material was prepared in the same manner as in Example 4, except that a pattern was further printed on the writing layer side of the biaxially oriented polyethylene terephthalate film. The resulting ID card material was made up into cards and evaluated by the same procedure as Example 1. The results are shown in Table 1.

Figure 11:
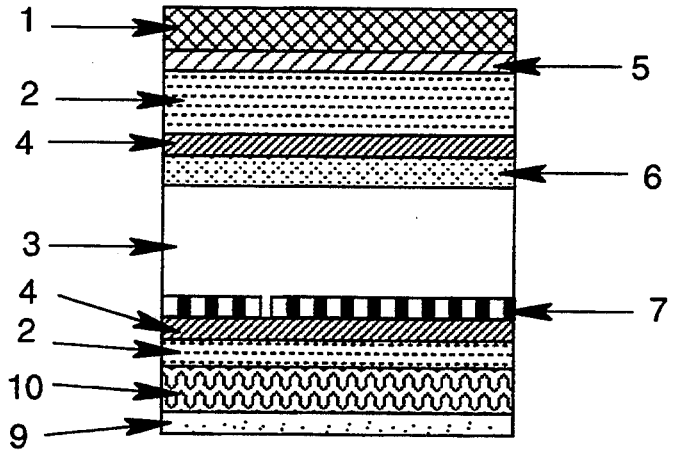
FIG. 11 is a cross-sectional view of another identification card formed by use of an ID card material prepared in one embodiment of the invention.

As indicated in FIG. 11, the layer configuration of this ID card material was polyvinyl chloride type resin film layer (image receiving layer) 1/anchoring layer 5/white polypropylene layer 2/adhesive layer 4/white opacifying layer 6/biaxially oriented polyethylene terephthalate layer 3/pattern-printing layer 7/adhesive layer 4/white polypropylene layer 2/YUPO synthetic paper 10/writing layer 9.

Example 7

An ID card material was prepared in the same manner as in Example 5, except that a pattern was further printed on the image receiving layer side of the biaxially oriented polyethylene terephthalate film. The ID card material obtained was made up into cards and evaluated by the same procedure as Example 1. The results are shown in Table 1.

The layer configuration of this ID card material was polyvinyl chloride type resin layer (image receiving layer)/anchoring layer/white polypropylene layer-/adhesive layer/pattern-printing layer/biaxially oriented polyethylene terephthalate film layer/white opacifying layer/adhesive layer/white polypropylene layer/YUPO synthetic paper/writing layer.

Example 8

After providing a corona discharge treatment on one side of a white biaxially oriented polyethylene terephthalate film, an anchoring layer (coating weight: 0.5 g/m$^2$) of the following composition 5, an image receiving layer (coating weight: 4.0 g/m$^2$) of the following composition 6, and a releasing layer (coating weight: 0.5 g/m$^2$) of the following composition 7 were laminated thereon. And, after printing a pattern on the other side of the film, a white opacifying layer of the foregoing composition 4 and a writing layer of the foregoing composition 2 were laminated to obtain an ID card material. This ID card material was made up into identification cards and evaluated by the same procedure as Example 1; the results are summarized in Table 1.

Figure 12:
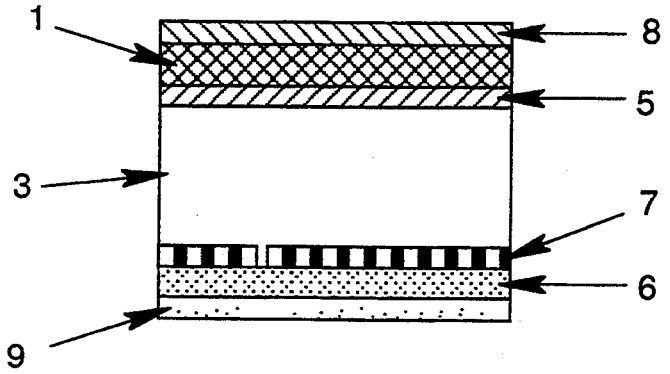
FIG. 12 is a cross-sectional view of another identification card formed by use of an ID card material prepared in one embodiment of the invention.

As shown in FIG. 12, this ID card material comprise releasing layer 8/polyvinyl chloride type resin layer (image receiving layer) 1/anchoring layer 5/white biaxially oriented polyethylene terephthalate film layer 3/pattern-printing layer 7/white opacifying layer 6/writing layer 9.

| Composition 5 | |
|---|---|
| Acrylic resin (BR-113 made by Mitsubishi Rayon Co.) | 9.0 parts |
| Aziridine compound (Chemitite PZ-33 made by Nippon Shokubai Co.) | 1.0 part |
| Methyl ethyl ketone | 90.0 parts |
| Composition 6 | |
| Polyvinyl butyral resin (Eslec BX-1 made by Sekisui Chem. Co.) | 5.0 parts |
| Metalsource | 5.0 parts |
| Methyl ethyl ketone | 90.0 parts |
| Composition 7 | |
| Polyethylene wax emulsion (E-5403A made by Toho Kagaku Co.) | 20.0 parts |
| Polyethylene type resin emulsion (S-3125 made by Toho Kagaku Co.) | 20.0 parts |
| Water | 60.0 parts |

Example 9

An ID card material was prepared by repeating the procedure of Example 7, except that a white opacifying layer of the foregoing composition 4 was formed at a coating weight of 10 g/m$^2$ between the printing layer and the 50-μm thick white polypropylene layer, instead of the white opacifying layer of Example 7. This ID card material was then made up into cards and evaluated as in Example 1; the results are shown in Table 1.

Figure 13:
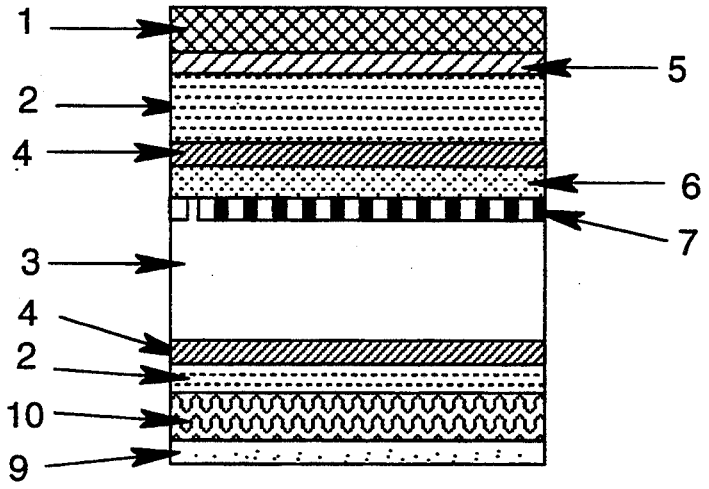
FIG. 13 is a cross-sectional view of still another identification card formed by use of an ID card material prepared in one embodiment of the invention.

As shown in FIG. 13, the layer configuration of this ID card material was polyvinyl chloride type resin layer (image receiving layer) 1/anchoring layer 5/white polypropylene layer 2/adhesive layer 4/white opacifying layer 6/pattern-printing layer 7/biaxially oriented polyethylene terephthalate film layer 3/adhesive layer 4/white polypropylene layer 2/YUPO synthetic paper 10/writing layer 9.

Example 10

An ID card material was prepared by the same procedure as Example 6, except that the adhesive layer was formed of the following composition 8, that the image receiving layer was formed of the foregoing composition 6, and that an releasing layer of the following composition 7 was further provided. This ID card material was made up into cards and evaluated as in Example 1; the results are shown in Table 1.

The layer configuration of this ID card material was releasing layer/polyvinyl chloride type resin layer (image receiving layer)/anchoring layer/white polypropylene layer/adhesive layer/white opacifying layer/biaxially oriented polyethylene terephthalate film layer/pattern-printing layer/adhesive layer/white polypropylene layer/YUPO synthetic paper/writing layer.

| Composition 8 | |
|---|---|
| Polyurethane resin (Desmocoll 400 made by Sumitomo-Bayer Urethane Co.) | 9.0 parts |
| Aziridine compound (Chemitite PZ-33 made by Nippon Shokubai Co.) | 1.0 part |
| Methyl ethyl ketone | 90.0 parts |

Example 11

The cards prepared in Examples 1 to 9 were cut to be in a sheet form and subjected to a heat treatment of 80° C. for 2 hours, and then these were evaluated in the same manner as in Example 1. The results are shown in Table 1, in which the letters A, B and C are the same as those for the stiffness in Example 1.

COMPARATIVE EXAMPLE 1

The procedure of Example 1 was repeated, except that an ID card material was prepared by laminating two 250-μm thick biaxially oriented polyethylene terephthalate sheets by dry lamination using a urethane adhesive. The layer configuration of this ID card material was biaxially oriented polyethylene terephthalate sheet (image receiving layer)/urethane adhesive layer/-biaxially oriented polyethylene terephthalate sheet (made by Dia-Foil Co. ). The evaluation results are shown in Table 1.

COMPARATIVE EXAMPLE 2

The procedure of Example 1 was repeated, except that an ID card material was prepared by laminating a 100-μm thick rigid transparent polyvinyl chloride sheet, a 280-μm thick rigid white polyvinyl chloride sheet and a 100-μm thick rigid transparent polyvinyl chloride sheet in this order. The layer configuration of this ID card material was rigid transparent polyvinyl chloride sheet (image receiving layer)/rigid white polyvinyl chloride sheet/rigid transparent polyvinyl chloride sheet. The evaluation results are shown in Table 1.

COMPARATIVE EXAMPLE 3

A 500-μm thick biaxially oriented polyethylene terephthalate sheet (made by Dia-Foil Co.) was evaluated as in Example 1. This ID card material consisted of a single layer of biaxially oriented polyethylene terephthalate sheet. The evaluation results are shown in Table 1.

TABLE 1

| | Curling | Thermal Deformation | Stiffness | Curling under Prolonged Forced Deforming | Curling under Heat Treatment |
|---|---|---|---|---|---|
| Example 1 | no curling | no deformation | A | A | A |
| Example 2 | no curling | no deformation | A | A | A |
| Example 3 | no curling | no deformation | A | A | A |
| Example 4 | no curling | no deformation | A | A | A |
| Example 5 | no curling | no deformation | A | A | A |
| Example 6 | no curling | no deformation | A | A | A |
| Example 7 | no curling | no deformation | A | A | A |
| Example 8 | no curling | no deformation | A | A | A |
| Example 9 | no curling | no deformation | A | A | A |
| Example 10 | no curling | no deformation | A | A | — |
| Comp. Example 1 | Slightly curling | no deformation | A | C | B |
| Comp. Example 2 | no curling | deformed | C | A | C |
| Comp Example 3 | curling | no deformation | A | A | C |

What is claimed is:

1. An ID card material comprising a thermal transfer image-receiving layer, and provided thereon, a substrate layer and a writing layer in this order, wherein the substrate layer comprises a biaxially oriented polyester film layer having a thickness of 300 to 500 μm and a resin layer having a thickness of 30 to 350 μm selected from the group consisting of a polyolefin layer, a polyvinyl chloride resin film layer and an ABS resin film layer.

2. The material of claim 1, wherein a white opaque layer is provided between the thermal transfer image-receiving layer and the substrate layer, between layers constituting the substrate layer or between the substrate layer and the writing layer, the white opaque layer comprising white pigment in an amount of 0.5 to 50% by weight.

3. The material of claim 1, wherein the biaxially oriented polyester film layer comprises white pigment in an amount of 0.5 to 50% by weight.

4. The material of claim 3, wherein an adhesive layer is further provided between the thermal transfer image receiving layer and the substrate layer.

5. The material of claim 3, wherein a white opaque layer is provided between the thermal transfer image-receiving layer and the substrate layer or between the substrate layer and the writing layer, the white opaque layer comprising white pigment in an amount of 0.5 to 50% by weight.

6. The material of claim 1, wherein the substrate layer comprises the biaxially oriented polyester film layer and the resin layer provided on each side thereof.

7. The material of claim 6, wherein the resin layer contains white pigment in an amount of 0.5 to 50% by weight.

8. The material of claim 6, wherein the resin layer is a polyethylene layer or a polypropylene layer.

9. The material of claim 8, wherein an adhesive layer is provided between the polyethylene layer or the polypropylene layer and the biaxially oriented polyester film layer.

10. The material of claim 9, wherein the biaxially oriented polyester film layer comprises white pigment in an amount of 0.5 to 50% by weight.

11. The material of claim 9, wherein the resin layer contains white pigment in an amount of 0.5 to 50% by weight.

12. An ID card material comprising a thermal transfer image-receiving layer, and provided thereon, a substrate layer and a writing layer in this order, wherein the substrate layer consists of a biaxially oriented polyester film layer having a thickness of 300 to 500 μm.

13. A process of producing an ID card comprising the steps of:

forming an image by a thermal transfer recording method on a thermal transfer image-receiving layer of an ID card material;

providing a protective layer on the formed image;

coating an ultraviolet-curable resin on the image-receiving layer; and irradiating ultraviolet ray to the coated resin layer to cure the resin, the ID card material comprising a thermal transfer image-receiving layer, and provided thereon, a substrate layer and a writing layer in this order, wherein the substrate layer comprises a biaxially oriented polyester film layer having a thickness of 300 to 500 μm and a resin layer having a thickness of 30 to 500 μm selected from the group consisting of a polyolefin layer, a polyvinyl chloride resin film layer and an ABS resin film layer.

* * * * *